United States Patent [19]

Szczepanek

[11] Patent Number: 4,509,346

[45] Date of Patent: Apr. 9, 1985

[54] HANDCUFF LOCK CONSTRUCTION

[75] Inventor: Thaddeus J. Szczepanek, Springfield, Mass.

[73] Assignee: Universal Tool Company, Inc., Springfield, Mass.

[21] Appl. No.: 541,674

[22] Filed: Oct. 13, 1983

Related U.S. Application Data

[63] Continuation-in-part of Ser. No. 327,812, Dec. 7, 1981, abandoned.

[51] Int. Cl.[3] ..... E05B 75/00

[52] U.S. Cl. ..... 70/16

[58] Field of Search ..... 70/14–19; 292/106, 170, 207; 119/128

[56] References Cited

U.S. PATENT DOCUMENTS

| | | | |
|---|---|---|---|
| 7,873 | 9/1877 | Phelps . | |
| 14,714 | 8/1919 | Pratt . | |
| 308,075 | 11/1884 | Johnson . | |
| 930,014 | 8/1909 | Wood . | |
| 1,342,334 | 6/1920 | Kruger . | |
| 1,531,451 | 4/1925 | Neal . | |
| 1,579,333 | 4/1926 | Neal . | |
| 1,851,206 | 4/1932 | Neal . | |
| 1,855,686 | 4/1932 | Neal . | |
| 1,872,857 | 8/1932 | Wesson et al. . | |
| 1,900,242 | 4/1933 | Latou . | |
| 4,300,368 | 11/1981 | Sullivan | 70/16 |
| 4,314,466 | 2/1982 | Harris | 70/16 |

*Primary Examiner*—Robert L. Wolfe
*Assistant Examiner*—Lloyd A. Gall
*Attorney, Agent, or Firm*—Lee A. Strimbeck

[57] ABSTRACT

In a handcuff device of the double locking type having a latch with inclined teeth which allows the locking arm of the cuff to rotate about and enclose the wrist and hold the locking arm in place around the wrist and having a bolt behind the latch that is slideable under the action of an externally actuated drift pin over the latch to a locking position that locks the latch against the locking arm preventing movement of the locking arm in either direction. The unintentional movement of the bolt into its locking position is prevented by providing a restraining means—a spring loaded pin—that operates against the casing and the bolt to resiliently urge the bolt against the latch and against the spreading action of mating shoulders on the bolt and latch that cause the two to spread apart against the action of the restraining means as the bolt moves forward towards the locking position and the shoulders engage. The resistance offered by the restraining means against the spreading action of the shoulders is sufficient to overcome any internal movement of the bolt if the cuff is struck or jarred. The latch also preferably has an inclined face against which the drift pin acts to ease the effort required to spread the bolt from the latch and move it into the locking position.

3 Claims, 3 Drawing Figures

FIG. 2
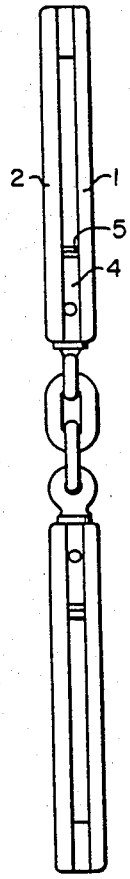
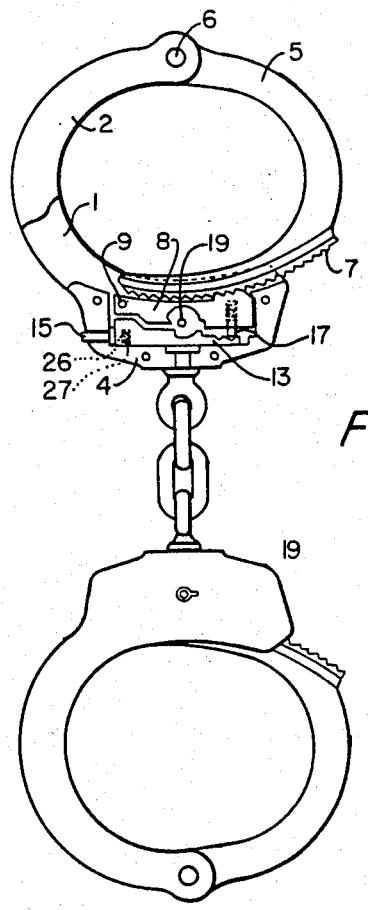
FIG. 1
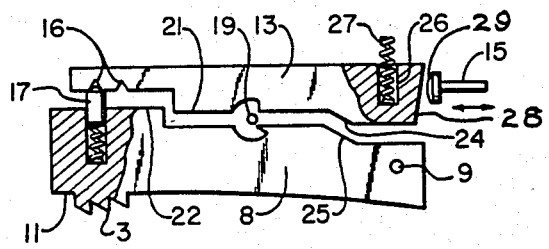
FIG. 3

HANDCUFF LOCK CONSTRUCTION

RELATED APPLICATION

This application is a continuation-in-part of Ser. No. 327,812, "Handcuff Lock Construction", filed Dec. 7, 1981, by the present inventor.

PRIOR ART

This invention is a specific improvement of the type of double locking shackle device or handcuff shown in U.S. Pat. No. 1,872,857 issued Aug. 23, 1932 to Wesson et al. In this type of handcuff an arcuate locking arm moves circularly through one side of a casing and has inclined teeth at its free end that engage like inclined teeth on a ratchet pawl or latch pivotally mounted within the casing. Once engaged, the teeth and latch permit further closing of the locking arm, but not opening thereof. A bolt behind the latch can be slid into position by a key applied from outside the latch which so locks the latch as to prevent movement of the locking arm in either direction.

THIS INVENTION

With a double locking handcuff the person applying the cuff normally carries the handcuffs in his pocket or on his belt with the bolt that locks the latch in its retracted or unlocked position. When the cuff is to be applied, the cuff is brought smartly down on the wrist causing the locking arm to swing arcuately around the wrist and to engage the latch. At this point the locking arm can be further tightened but it cannot be loosened or released without a key.

Double locking handcuffs were developed to prevent unwanted and further tightening of the locking arm. A bolt operated by being pushed with a tool or key from outside the casing is used to lock the latch and prevent its ratcheting action. A problem with such double locking handcuffs is that while being carried about from day to day the bolt may unintentionally be jostled into its locking position such that when one goes to apply the handcuffs they do not work, i.e. they do not close about the wrist. In a crisis situation this can be upsetting.

Handcuffs are always expected to be, and should be, in a functional and unlocked position ready for quick action. Time can be very important in shackling a prisoner.

The present invention overcomes this problem and others by modifying the coacting bolt and latch of the double locking handcuff in two ways. First, mating shoulders are provided on the latch and bolt near the pivot point of the latch. These shoulders cause the bolt to slide up and over the latch with the widening of the distance between the longitudinal axis of the two. Secondly, a spring or like means is used to resiliently urge the bolt towards the latch such that some considerable effort is required to move the bolt over the shoulder of the latch into its locking position. This effort is beyond the momentum produced by the mass of the bolt even when the cuff is struck smartly in a direction that normally would cause the bolt to move toward its locking position. Consequently, the bolt can be shifted to its locking position only by virtue of pushing the back end of the bolt with a tool or key applied from the outside of the casing of the cuff to a drift pin in contact with the end of the bolt.

Once applied and locked, the bolt can be released in the usual manner by use of the key applied from outside the casing of the cuff by turning the key in one direction. The locking arm can be then fully released by turning the key in the opposite direction in a known manner to lift the latch and disengage the locking arm.

However, a fair amount of effort may now have to be applied to the drift pin to shift the bolt to the locking position. A third feature of this invention is to ameliorate this effort by inclining the face of the bolt against which the pin acts and rounding the nose of the pin so as to have the pin pushing action effect some lifting of the bolt over the shoulders.

DRAWINGS

In the drawings:

FIG. 1 is a plan view of a pair of cuffs in part broken away to show the locking mechanism modified in the two manners prepared by this invention;

FIG. 2 is a side view of the cuffs; and

FIG. 3 is an enlarged detail of the bolt and latch of the cuff, and showing the third feature of this invention, which is not illustrated in FIG. 1.

DESCRIPTION

With reference to the drawing, 1 and 2 are parallel arms spaced at one end by a U-shaped lock casing frame 4 and at the other end by an arcuate locking arm 5 swivelled on pin 6. Arm 5 is provided with inclined or ratchet teeth 7 on its free end. Teeth 7 are adapted to click by like teeth 3 on a latch or ratchet pawl 8 when moving clockwise (as illustrated). Arm 5 is prevented by the teeth and the pawl from moving counterclockwise. Pawl 8 pivots on pin 9 fixed to the casing 4. Pawl 8 at its other end has a ledge 11 which engages a like ledge on the casing which prevents the pawl from falling from the casing.

A bolt 13 lies behind pawl 8 in casing 4. A movable drift pin 15 which can be pushed by a small rod or pin from outside the casing operates to push the back end of bolt 13 to its locking position. In FIG. 1 the face of drift pin 15 and the end of bolt 13 which it contacts are shown in flat face-to-face contact, which is how they were constructed in prior devices. FIG. 3 illustrates how these faces are modified in accordance with this invention. The other end of the bolt 13 has two spaced notches 16 adapted to be engaged alternately by a spring loaded pin 17 in pawl 8. When bolt 13 is in its retracted position and spring-loaded pin 17 engages the first or outer notch 16 of bolt 13 then pawl 8 and its teeth 3 are resiliently urged against the mating teeth 7 of arm 5 such that as arm 5 is rotated in the clockwise direction (as illustrated), teeth 7 will force teeth 3 and pawl 8 back against the spring action of pin 17 with teeth 7 slipping by teeth 3 and closure of the handcuff occurring.

When bolt 13 is in its forward position and pin 17 engages the second or inner notch 16 then a shoulder 21 engages a like shoulder 22 on pawl 8 holding it firmly down such that it cannot rise up against the action of springloaded pin 17, thus effecting the double locking action of the handcuff and preventing motion of arm 5 in either direction.

As is known, the bolt 13 may be put in its retracted unlocked position and pawl 8 then lifted to disengage teeth 3 and 7 to permit opening of the handcuff by the insertion of a key through the casing and operation of it around pin 19 first in one direction to move the bolt and then in the other to lift the pawl.

What has so far been described is known and has been described in the prior art.

In accordance with the teachings of the present invention, the unintended sliding or slipping of bolt 13 into its forward locking position is prevented by providing bolt 13 with a rounded or included shoulder 24 which engages a mating shoulder 25 on pawl 8. The action of the two shoulders is such that as bolt 13 is moved by pin 15 towards its forward locking position, shoulder 24 must ride up on shoulder 25. This causes the longitudinal axes of bolt 13 and pawl 8 to spread apart. A recess 26 containing a spring 27 is provided at the end of bolt 13 adjacent the pivot point of pawl 8. The spring 27 operates against the wall of casing 4 and urges that end of bolt 13 towards pawl 8. Thus, as bolt 13 moves forward and shoulder 24 commences to ride up on shoulder 25, the resistance offered by spring 27 must be overcome. The resistance offered by spring 27 is gauged to be sufficient to prevent bolt 13 from moving forward to its locking position even when the handcuffs are roughly treated or sharply hit. Bolt 13 can only be put into its locking position by being pushed forward by pin 15 operated by hand from outside of the casing.

In operation, bolt 13 is normally kept in its retracted position such that the first or outer notch 16 on bolt 13 engages pin 17. The handcuffs are then applied to the wrist and arm 5 swung into place engaging teeth 7 with teeth 3 of pawl 8 in a ratcheting manner locking the handcuffs to the wrist. When arm 5 is in position pin 15 is then pushed forward from outside casing 4, as by a pin on the end of the handcuff key, sliding bolt 13 forward such that pin 17 engages the second or inner notch 16 of bolt 13 and shoulder 21 engages shoulder 22 holding pawl 8 down and preventing it from lifting up and allowing teeth 7 to slide by teeth 3, i.e. arm 5 cannot move in either direction when the bolt 13 is forward and the handcuffs are double locked. To release the handcuffs a conventional key is inserted at 19 and first rotated, with reference to FIG. 3, clockwise to slide bolt 13 back and then counterclockwise to engage pawl 8 and lift teeth 3 free of teeth 7 which allows arm 5 to open.

Addition of shoulders 24 and 25 and of restraining means 27 makes the force required to place bolt 13 in the double locked position quite considerable if the faces of pin 15 and bolt remain as shown in FIG. 1. However, with reference to FIG. 3, if the end face 28 of bolt 13 is angled, as shown, and if the nose 29 of pin 15 is complimentarily sloped as by being rounded in accordance with the third feature of this invention, then as pin 15 is pushed in to move bolt 13 some of the pushing force is translated into a lifting force that tneds to spread bolt 13 and latch 8 apart and lift shoulder 24 over shoulder 25. This then makes it easier to move bolt 13 into the double locked position.

What is claimed is:

1. In a double-locking shackle device having (1) a casing, (2) a fixed arm, one end of which is held by said casing, (3) a movable arcuate locking arm, one end of which is pivotally mounted to the other end of said fixed arm and which has a first series of inclined teeth at its free end, said locking arm being adapted to have said free end move circularly through one side of said casing, (4) an elongated latch pivotally mounted by one end within said casing, the free end of which latch has a second series of inclined teeth adapted to engage said first series, (5) an elongated bolt within said casing and adjacent and behind said elongated latch, (6) restraining means between said latch and bolt normally resiliently urging said latch and said second series of inclined teeth against said first series and permitting closure of said locking arm but not opening thereof, said bolt being slideable within limits along the axis of its length from a locking position of engagement with said latch preventing movement thereof and disengagement of said first and second series of inclined teeth to an unlocked, retracted position allowing movement of said latch and closure of said locking arm, and (7) a drift pin in said casing at the end of said bolt and effecting movement of said bolt into said locking position by said drift pin being pushed from outside said casing against said end; the improvement restraining the unwanted sliding movement of said bolt comprising a first shoulder on said latch near the pivot point thereof and facing said bolt, a second shoulder on said bolt adapted to slideably engage said first shoulder and as the two shoulders engage to effect a widening between the longitudinal axes of said latch and bolt; a second restraining means between said casing and said bolt resiliently urging said bolt toward said latch and causing an increase in the effort required to effect riding up of said second shoulder on said first shoulder as said bolt moves towards said locking position; and an inclined face on said end of said bolt contacting the nose of said drift pin and said nose being complimentarily sloped to effect a lifting action on said end when said drift pin is pushed.

2. The device of claim 1 wherein there is a keyway in said casing between said latch and bolt, and said latch and bolt are each adapted to receive and engage a key inserted in said keyway which key when turned one way operates to place said bolt in said unlocked, retracted position and when turned the other way serves to retract said latch and effect disengagement of said first and second series of teeth.

3. The shackle device of claim 1 wherein said nose is rounded.

* * * * *